US011686023B2

(12) United States Patent
Candiani

(10) Patent No.: US 11,686,023 B2
(45) Date of Patent: Jun. 27, 2023

(54) METHOD FOR MAKING AN ELASTICISED YARN AND FABRIC MANUFACTURED FROM SAID YARN

(71) Applicant: CANDIANI S.P.A., Robecchetto County Induno (IT)

(72) Inventor: Alberto Primo Candiani, Milan (IT)

(73) Assignee: CANDIANI S.P.A., Robecchetto County Induno (IT)

( * ) Notice: Subject to any disclaimer, the term of this patent is extended or adjusted under 35 U.S.C. 154(b) by 234 days.

(21) Appl. No.: 17/288,436

(22) PCT Filed: Sep. 12, 2019

(86) PCT No.: PCT/IB2019/057703
§ 371 (c)(1),
(2) Date: Apr. 23, 2021

(87) PCT Pub. No.: WO2020/084359
PCT Pub. Date: Apr. 30, 2020

(65) Prior Publication Data

US 2021/0395930 A1 Dec. 23, 2021

(30) Foreign Application Priority Data

Oct. 25, 2018 (IT) ..... 102018000009805

(51) Int. Cl.
*D01D 5/00* (2006.01)
*D03D 15/56* (2021.01)

(52) U.S. Cl.
CPC ..... *D03D 15/56* (2021.01); *D10B 2201/01* (2013.01); *D10B 2401/061* (2013.01)

(58) Field of Classification Search
CPC ..... D03D 15/56; D10B 2201/01; D10B 2401/061; D10B 2211/01; D02G 3/324
See application file for complete search history.

(56) References Cited

U.S. PATENT DOCUMENTS 2,263,612 A * 11/1941 Chittenden ..... D02G 3/328 57/313
2,992,150 A * 7/1961 Stansfield ..... D02G 3/447 474/263

(Continued)

FOREIGN PATENT DOCUMENTS

| | | |
|---|---|---|
| EP | 2145034 A1 | 1/2010 |
| EP | 2638192 A1 | 9/2013 |
| GB | 827 561 A | 2/1960 |

*Primary Examiner* — Robert H Muromoto, Jr.
(74) *Attorney, Agent, or Firm* — Maschoff Brennan

(57) ABSTRACT

A method for making an elasticised yarn includes feeding a roving made of a cotton-based natural fibre at a weight percentage of at least 50% and having a linear mass density between 0.1 Nm and 50 Nm, to a stretching unit, and extracting it from the stretching unit at a speed higher than the unwinding speed. The stretched roving and an elastic fibre are jointly pulled through an overlapping unit, forming a spool of the elasticised yarn. The elastic fibre includes a natural rubber containing more than 80% polyisoprene 1,4-cis. The elastic fibre also includes sulphur as a vulcanization agent; a vulcanization accelerator and a vulcanization activator; an anti-tacking agent; an antioxidant agent; and a stabilisation agent. The elastic fibre is obtained by longitudinally cutting a longitudinally cut flat yarn made of the natural rubber, to attain a linear mass density between 50 dtex and 1000 dtex.

20 Claims, 1 Drawing Sheet

(56) References Cited

U.S. PATENT DOCUMENTS

| | | | | |
|---|---|---|---|---|
| 3,380,244 | A * | 4/1968 | Martin | D02G 3/328 57/239 |
| 5,376,118 | A * | 12/1994 | Kaplan | A61F 2/08 606/228 |
| 6,267,744 | B1 * | 7/2001 | Roberts | A61F 13/00021 602/76 |
| 7,762,287 | B2 * | 7/2010 | Liao | D03D 15/47 139/421 |
| 10,278,871 | B2 * | 5/2019 | Broz | A61F 13/105 |
| 10,428,445 | B2 * | 10/2019 | Agarwal | D03D 15/47 |
| 10,704,168 | B2 * | 7/2020 | Yenici | D02G 3/38 |
| 11,499,251 | B2 * | 11/2022 | Yenici | D03D 15/56 |
| 2007/0259583 | A1 * | 11/2007 | Laycock | D02G 3/324 442/184 |
| 2017/0275788 | A1 * | 9/2017 | Agarwal | D02G 1/0266 |
| 2021/0388538 | A1 * | 12/2021 | Benelli | D02G 3/322 |

* cited by examiner

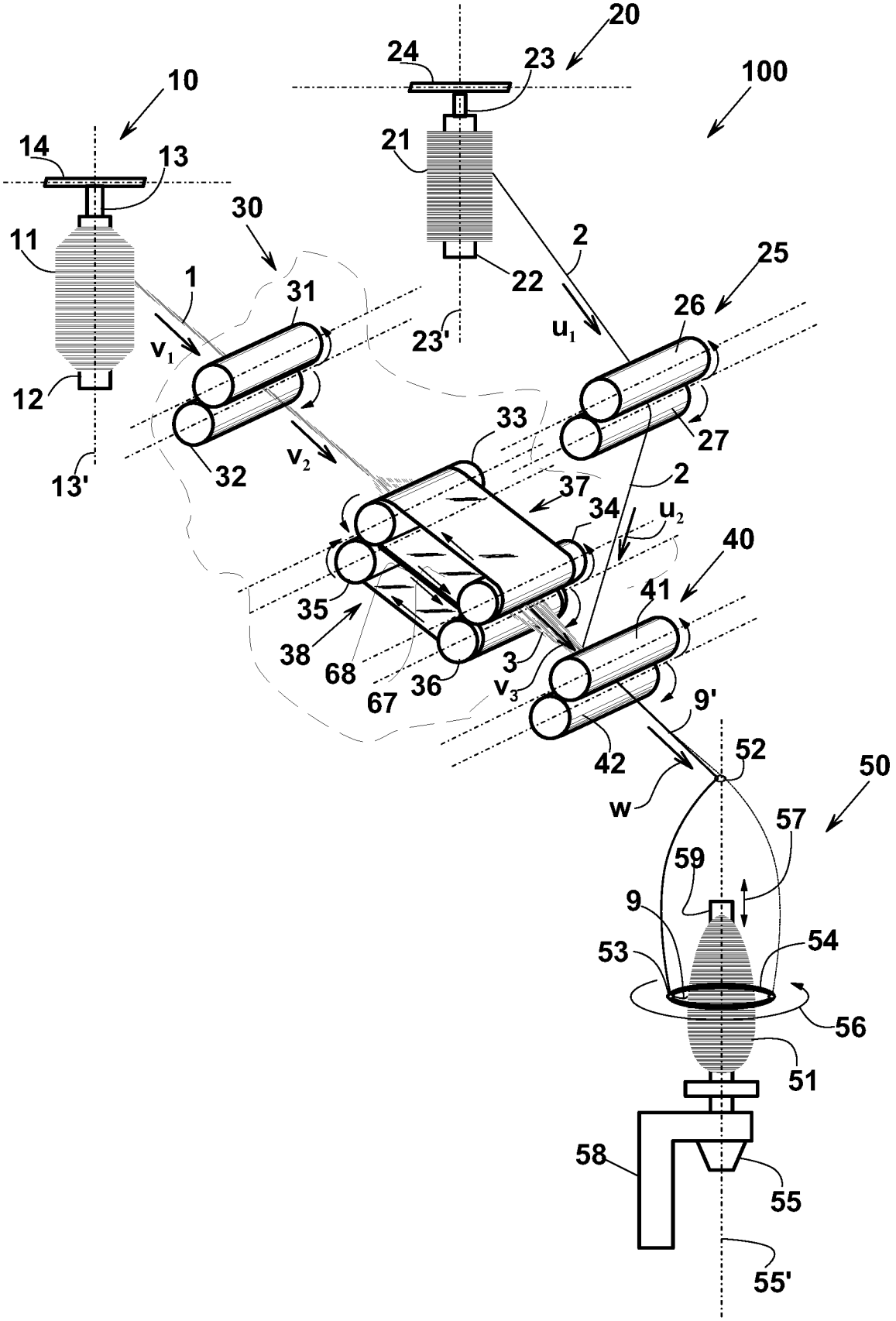
20
24
23
100
10
14
13
21
30
11
2
25
1
31
22
26
23'
u1
v1
12
33
27
32
v2
2
13'
37
34
u2
40
41
35
38
68
36
3
v3
67
9'
42
52
50
w
57
59
9
53
54
56
51
58
55
55'

METHOD FOR MAKING AN ELASTICISED YARN AND FABRIC MANUFACTURED FROM SAID YARN

BACKGROUND OF THE INVENTION

Field of the Invention

The present invention relates to a method for making cotton-based elasticised yarns by a core-spun technique, and also relates to elasticised fabrics manufactured from such elasticised yarns.

Technical Problem

As well known, elasticised fabrics are used for a wide range of applications. In particular, garments are made that do not hinder the movements of the user's limbs, or conform themselves to these movements, thus generating a comfort sensation. This feature is particularly appreciated in underwear clothing and in sport and gym clothes, but is appreciated in such everyday-life situations as sitting in a car, walking and whenever the joints are bent.

The features of the elasticised fabrics depend on the high elasticity of the elasticised yarns used for their manufacture. For instance, documents U.S. Pat. Nos. 2,992,150, 3,380,244, EP2145034 and EP2638192 describe elastic yarns obtained by such a spinning technique as ring-spinning or the like, in which an elastic thread is surrounded by a fibrous sheath comprising a mass of synthetic or natural staple fibres, in some cases made of cotton.

Elasticised denim type fabrics, referred to for example in EP2145034 and EP2638192, have been appreciated for years, and allowed to extend the above-mentioned advantages and comfort to jeans garments.

However, the elastic threads conventionally used to make the above described elasticised yarns are synthetic threads, in particular in the above documents relate to polyurethane or polyolefin materials. For this reason, the articles obtained using fabrics made from cotton and such an elastic thread cannot be advantageously disposed in a natural way, e.g. by making compost. Moreover, the synthetic thread can be allergenic to some people wearing such garments.

In order to mitigate these drawbacks, a solution alternative to synthetic threads could be the use of natural rubber. However, natural rubber threads are most easily available with a linear mass density far higher than synthetic elastic threads, so they cannot be used to make elasticised yarns by currently preferred spinning techniques, such as ring-spinning or open-end spinning.

Lower linear mass density elastic natural rubber threads have been recently proposed, but they are likely to break when used in the above-mentioned spinning techniques, so elasticised yarns comprising natural rubber are very hard and/or uneconomical to manufacture. In any case, even if the elasticized yarn production rate is decreased to prevent the natural rubber elastic thread from breaking, the elastic thread will most likely break when using the elasticised yarn to manufacture an elasticised fabric, in particular a denim type elasticised fabric, which is therefore in turn very hard and/or uneconomical to make.

SUMMARY OF THE INVENTION

Therefore, the present invention aims at providing a method for making an elasticised yarn starting from an elastic thread and a cotton-based yarn, which makes it possible to use a natural rubber, as the elastic thread, thus overcoming the problems involved by well-known elasticised yarn and fabric production processes, as summarized above.

Another particular object is providing such an elasticised yarn suitable for making denim type fabrics.

These and other objects are achieved by a method as defined by attached claim 1. Exemplary specific embodiments of the invention are defined by the dependent claims. Such objects are also achieved by a fabric as defined by claim 12.

A method for making an elasticised yarn comprises the steps of:

- prearranging a source of a roving of a 100% natural fibre, wherein the roving has a linear mass density set between 0.1 Nm and 50 Nm, preferably between 0.3 Nm and 25 Nm;
- prearranging a source of an elastic fibre;
- feeding the roving to a stretching unit at a first speed $v_1$;
- extracting the roving as stretched roving by the stretching unit at a second speed $v_3>v_1$;
- unwinding the elastic fibre;
- conveying the elastic fibre to an overlapping unit at a third speed $v_2$;
- jointly pulling the elastic fibre and the stretched roving, downstream of the overlapping unit, by a ring spinning unit, by making a spool of the elasticised yarn.

According to the invention, the elastic fibre comprises:

- natural rubber having a polyisoprene 1,4-cis content larger than 80%;
- the following further components:
  - a vulcanisation agent, wherein the vulcanisation agent is sulphur at a weight concentration in the natural rubber set between 0.5% and 3.0%;
  - a vulcanization accelerator and a vulcanization activator;
  - an anti-tacking agent;
  - an antioxidant agent;
  - a stabilisation agent;

moreover, the elastic fibre is obtained from a longitudinally cut flat yarn of the natural rubber so as to obtain the elastic fibre in the form of an elastic thread having a linear mass density set between 50 dtex and 1000 dtex, preferably between 100 dtex and 800 dtex, in particular between 150 dtex and 500 dtex.

This way, by the above natural rubber composition, a cotton-based elasticised yarn can be obtained in which the elastic fibre is not likely to break either when being spun, or when used to make a fabric, in particular a denim fabric. The elasticised yarn obtained this way overcomes the drawbacks of the prior art, since it consists of natural rubber and cotton, and makes it possible to reach linear mass densities suitable for making light and comfortable elasticised fabrics, while preventing the elastic core from frequently break during both yarn and fabric manufacture.

Polyisoprene 1,4-cis can be obtained by a plant selected from the group consisting of:

*Hevea brasiliensis;*
*Hevea guianensis;*
*Hevea benthamiana.*

Advantageously, the vulcanisation agent is sulphur at a weight concentration set between 1% and 2.5% in the natural rubber.

One or more of the further components that the natural rubber comprises can be present at the weight percentages indicated below:

0.1-2% of a thiazolic vulcanization accelerator, with respect to the weight of the dry rubber;

1-10% of a vulcanization activator comprising a fatty acid, in particular stearic acid, with respect to the weight of the dry rubber;

1-5% of an anti-tacking agent comprising talc, with respect to the weight of the dry rubber.

In particular, the vulcanisation agent is present in the elastic fibre in the form of sulphur atom bridges, wherein at least 95% of the sulphur bridges comprises at least 4 sulphur atoms.

It falls within the scope of the present patent application also an elasticised yarn manufactured as described above.

It falls within the scope of the present patent application also an elasticised denim fabric comprising the elasticised above described yarn in an arrangement selected from the group consisting of:

an a weft arrangement;

an a warp arrangement;

a combination thereof.

BRIEF DESCRIPTION OF THE DRAWINGS

The invention will be now shown with the following description of its exemplary embodiments, exemplifying but not limitative, with reference to attached FIG. 1, which diagrammatically shows an apparatus for making the elasticised yarn according to the invention.

DESCRIPTION OF PREFERRED EXEMPLARY EMBODIMENTS

With reference to FIG. 1, a method for making an elasticised yarn comprises steps of prearranging sources 10,20 of a roving 1 and of an elastic fibre 2, respectively. Roving 1 is made of a natural fibre by 100% of its own composition. In an exemplary embodiment, roving 1 comprises cotton, in particular, at a weight percentage of at least 50%, and has a linear mass density set between 0.1 Nm and 50 Nm, preferably between 0.3 Nm and 25 Nm.

Sources 10,20 of roving 1 and of elastic fibre 2 can comprise spools or bobbins 11,21, in which the textile material is wound about hollow or full cores 12,22. In particular, core 12 of source 10 of the roving is rotatably arranged about a shaft 13 that defines a rotation axis 13'.

In particular, FIG. 1 shows a production unit 100 for making an elasticised yarn 9, the production unit being typically a part of a production machine along with a plurality of preferably identical units, and comprising a bar 14 on which a respective spool 11 or the like of roving 1 is mounted via shaft 13. Production unit 100 also comprises parallel rods 28,29 rotatably arranged about respective longitudinal axes, forming a cradle for corresponding spools or the like of elastic fibre 2, in order to allow spool rotation and elastic fibre unwinding. By this arrangement, multiple spools 51 of elasticised yarn 9 can be manufactured at the same time.

The method also comprises steps of feeding elastic fibre 2 and roving 1 to respective stretching units 25,30.

In particular, stretching unit 25 of elastic fibre 2 can comprise a couple of rollers 26,27 arranged to counter rotate with respect to each other and in contact with each other, so as to receive and pull elastic fibre 2 by friction. This way, the operation of stretching unit 25 causes elastic fibre 2 to be unwound from spool 21 at a fibre unwinding speed u1, and causes spool 21 to rotate about a shaft 23 and an axis 23'. The rotation speed of rollers 26,27 can be adjusted so that elastic fibre 2 is released at a stretched fibre speed u2 when leaving stretching unit 25.

Stretching unit 30 of roving 1 is configured to receive roving 1 at an unwinding speed $v_1$, and to release roving 3 at a release speed $v_3>v_1$, which causes a predetermined roving stretch ratio.

In one embodiment, as depicted in FIG. 1, stretching unit 30 can comprise a couple of pre-stretching rollers 31,32 arranged to counter rotate with respect to each other and in contact with each other, so as to receive and pull roving 1 by friction. This way, the operation of pre-stretching rollers 31,32 causes roving 1 to be unwound from spool 11 at a roving unwinding speed v1, and causes spool 11 to rotate about shaft 13 and axis 13'. The rotation speed of pre-stretching rollers 31,32 can be adjusted, so that roving 1 is released as a pre-stretched roving 1' at a pre-stretch speed $v_2$.

Moreover, stretching unit 30 is configured to open the fibres of roving 1, i.e. to arrange them in a substantially flat laid-down configuration of pre-stretched roving 1', yet since leaving pre-stretching rollers 31,32.

Stretching unit 30 of roving 1 includes a stretching device 39 in turn comprising two endless webs or belts 37,38, in this case arranged to be slidably moved by respective pairs of rotating drive cylinders 33,34 and 35,36 parallel to each other and arranged at a predetermined distance from each other. Endless webs 37,38 have respective portions 67,68 facing each other at a such a minimum distance from each other to receive and flatten roving 1 or possibly pre-stretched roving 1', as in FIG. 1, such that the fibres of stretched roving 3 when leaving stretching unit 30 have a substantially flat arrangement. The rotation speed of the cylinders of the pairs 33,34 and 35,36 are selected so as to further stretch the roving, obtaining a stretched roving 3.

More in detail, cylinders 35,36 are arranged to counter rotate with respect to cylinders 33,34, such that mutually facing portions 67,68 of respective webs 37,38 can move parallel to each other and in the same direction.

The method also comprises a step of extracting stretched roving 3 at a roving release speed $v_3$, and a step of conveying elastic fibre 2 and stretched roving 3 into an overlapping unit 40, where elastic fibre 2 is inserted between the fibres of stretched roving 3. To this purpose, preferably, overlapping unit 40 comprises a couple of rollers 41,42 arranged to counter rotate with respect to each other and in contact with each other, so as to receive elastic fibre 2 and stretched roving 3, and to cause them to be coupled in a tighter structure of a product 8.

The above described steps of extraction and conveying are driven by a step of jointly pulling product 8 being formed, downstream of overlapping unit 40, by a conventional ring spinning unit 50, comprising a support 58 on which a spool 59 is arranged to receive elasticised yarn 9. More in detail, spool 59 is rotatably and slidably arranged about/along a longitudinal axis 55', as indicated by the arrows 56 and 57, and is driven by a motor 55. Ring spinning unit 50 also comprises a conveying orifice 52 that is arranged at a predetermined distance from spool 59 and preferably along axis 55' thereof, and is configured to receive product 8 being formed at a yarn formation speed w, product 8 comprising elastic fibre 2 and the fibres of stretched roving 3. Ring spinning unit 50 also comprises a ring 53 that is arranged to rotate about its axis 55' at a predetermined speed along a guide 54, and that is also configured to receive product 8 being formed, an end of which is preliminary fixed on spool core 59. This way, the rotation of ring 53 causes product 8 being formed to be stretched and twisted at the same time, while being wound about spool core 59, and so collected in spool 51 of elasticised yarn 9, where the fibres of the roving turn from the substantially parallel arrangement of product 8 being formed to the final mutually twisted configuration of elasticised yarn 9.

Equivalent production units can also be provided as well known to a skilled person.

According to the invention, elastic fibre 2 comprises natural rubber with a polyisoprene 1,4-cis content higher than 80%. Elastic fibre 2 also comprises further components, and precisely a vulcanisation agent; a vulcanization accelerator and a vulcanization activator; an anti-tacking agent; an antioxidant agent; a stabilisation agent. Moreover, elastic fibre 2 is obtained from a longitudinally cut flat yarn of natural rubber so as to obtain an elastic filament with a linear mass density set between 50 dtex and 1000 dtex, preferably between 100 dtex and 800 dtex, in particular between 150 dtex and 500 dtex.

Preferably, polyisoprene 1,4-cis of elastic fibre 2 is obtained from a plant selected among *Hevea brasiliensis; Hevea guianensis; Hevea benthamiana.*

Advantageously, the vulcanisation agent is sulphur at a weight concentration set between 1% and 2.5%.

Preferably, the natural rubber comprises at least one of the further components according to a weight ratio selected from the group consisting of:

- 0.1-2% of a thiazolic vulcanization accelerator, with respect to the weight of the dry rubber;
- 1-10% of a vulcanization activator comprising a fatty acid, in particular stearic acid, with respect to the weight of the dry rubber;
- 1-5% of an anti-tacking agent containing talc.

Preferably, the vulcanisation agent is present in elastic fibre 2 in the form of sulphur atom bridges, wherein at least 85% of the sulphur bridges comprises at least 4 sulphur atoms.

It also falls within the scope the invention an elasticised denim fabric comprising the above described elasticised yarn in an arrangement selected among a weft arrangement, a warp arrangement and a weft and warp arrangement.

The foregoing description exemplary embodiments of the invention will so fully reveal the invention according to the conceptual point of view, so that others, by applying current knowledge, will be able to modify and/or adapt for various applications such embodiment without further research and without parting from the invention, and, accordingly, it is therefore to be understood that such adaptations and modifications will have to be considered as equivalent to the specific embodiments. The means and the materials to realise the different functions described herein could have a different nature without, for this reason, departing from the field of the invention. It is to be understood that the phraseology or terminology that is employed herein is for the purpose of description and not of limitation.

The invention claimed is:

1. A method for making an elasticised yarn, comprising:

prearranging a source of a roving of a 100% natural fibre, wherein said roving has a linear mass density set between 0.1 Nm and 50 Nm;

prearranging a source of an elastic fibre;

feeding said roving to a stretching unit at a first speed $v_1$;

extracting said roving as stretched roving from said stretching unit at a second speed $v_3>v_1$;

unwinding said elastic fibre;

conveying said elastic fibre to an overlapping unit at a third speed $v_2$;

jointly pulling said elastic fibre and said stretched roving, downstream of said overlapping unit, by a ring spinning unit, by making a spool of said elasticised yarn, wherein said elastic fibre includes:

natural rubber having a polyisoprene 1,4-cis content larger than 80%;

sulphur as a vulcanisation agent at a weight concentration in said natural rubber set between 0.5% and 3.0%;

a vulcanization accelerator and a vulcanization activator;

an anti-tacking agent;

an antioxidant agent; and a stabilisation agent; and wherein said elastic fibre is obtained from a longitudinally cut flat yarn of said natural rubber so as to obtain said elastic fibre in the form of an elastic thread having a linear mass density set between 50 dtex and 1000 dtex.

2. The method according to claim 1, wherein said natural fibre comprises cotton at a weight percentage of at least 50%.

3. The method according to claim 1, wherein said roving has a linear mass density set between 0.3 and 25 Nm.

4. The method according to claim 1, wherein said elastic filament has a linear mass density set between 100 dtex and 800 dtex.

5. The method according to claim 1, wherein said elastic filament has a linear mass density set between 150 dtex and 500 dtex.

6. The method according to claim 1, wherein said polyisoprene 1,4-cis is obtained from a plant selected from the group consisting of:

*Hevea brasiliensis;*

*Hevea guianensis*; and

*Hevea benthamiana.*

7. The method according to claim 1, wherein said vulcanisation agent is sulphur at a weight concentration in said natural rubber set between 1% and 2.5%.

8. The method according to claim 1, wherein said natural rubber comprises at least one of said further components according to a weight ratio selected from the group consisting of:

- 0.1-2% of a thiazolic vulcanization accelerator, with respect to the weight of the dry rubber;
- 1-10% of a vulcanization activator comprising a fatty acid with respect to the weight of the dry rubber, and
- 1-5% with respect to the weight of an anti-tacking agent comprising talc of the dry rubber.

9. The method according to claim 8, wherein said fatty acid is stearic acid.

10. The method according to claim 1, wherein said sulphur is present in said elastic fibre in the form of sulphur atom bridges, wherein at least 95% of the sulphur atom bridges comprises at least 4 sulphur atoms.

11. An elasticised yarn made by the method according to claim 1.

12. An elasticised denim fabric comprising the elasticised yarn made by the method according to claim 1 in an arrangement selected from the group consisting of:

a weft arrangement;

a warp arrangement; and a combination thereof.

13. The elasticised yarn according to claim 11, wherein the natural fibre comprises cotton at a weight percentage of at least 50%.

14. The elasticised yarn according to claim 11, wherein the roving has a linear mass density set between 0.3 and 25 Nm.

15. The elasticised yarn according to claim 11, wherein the elastic filament has a linear mass density set between 100 dtex and 800 dtex.

16. The elasticised yarn according to claim 11, wherein the elastic filament has a linear mass density set between 150 dtex and 500 dtex.

17. The elasticised denim fabric according to claim 12, wherein the natural fibre comprises cotton at a weight percentage of at least 50%.

18. The elasticised denim fabric according to claim 12, wherein the roving has a linear mass density set between 0.3 and 25 Nm.

19. The elasticised denim fabric according to claim 12, wherein the elastic filament has a linear mass density set between 100 dtex and 800 dtex.

20. The elasticised denim fabric according to claim 12, wherein the elastic filament has a linear mass density set between 150 dtex and 500 dtex.

* * * * *